US007116191B2

(12) United States Patent
Wang

(10) Patent No.: US 7,116,191 B2
(45) Date of Patent: Oct. 3, 2006

(54) GROUND FAULT CIRCUIT INTERRUPTER WITH REVERSE WIRING PROTECTION

(75) Inventor: Ping Wang, Chuzhou (CN)

(73) Assignee: Wenzhou Sansheng Electrical Co., Ltd., (CN)

( * ) Notice: Subject to any disclaimer, the term of this patent is extended or adjusted under 35 U.S.C. 154(b) by 0 days.

(21) Appl. No.: 11/072,855

(22) Filed: Mar. 3, 2005

(65) Prior Publication Data

US 2006/0044087 A1 Mar. 2, 2006

Related U.S. Application Data

(63) Continuation-in-part of application No. 10/945,672, filed on Sep. 21, 2004.

(30) Foreign Application Priority Data

Sep. 1, 2004 (CN) ..... 2004 2 0079238
Feb. 8, 2005 (CN) ..... 2005 1 0007673

(51) Int. Cl.
*H01H 73/00* (2006.01)

(52) U.S. Cl. ..... 335/18; 361/42

(58) Field of Classification Search ..... 335/18; 361/42
See application file for complete search history.

(56) References Cited

U.S. PATENT DOCUMENTS 6,580,344 B1 * 6/2003 Li ..... 335/18
6,949,994 B1 * 9/2005 Germain et al. ..... 335/18
2005/0012575 A1 * 1/2005 Huang et al. ..... 335/18
2005/0140476 A1 * 6/2005 Gao ..... 335/18

* cited by examiner

*Primary Examiner*—Lincoln Donovan
(74) *Attorney, Agent, or Firm*—Hogan & Hartson L.L.P.

(57) ABSTRACT

A circuit interrupter comprises a pair of fixed contact strips, a pair of load contact strips, a pair of movable contact strips, a reset component, a movable component, and a tripping component that contains a reset contact. Each of the fixed contact strips has a fixed contact. Each of the load contact strips has a load contact. Each of the movable contact strips has a fixed end and a movable end. Each movable end has a first movable contact arranged for contacting one of the corresponding load contacts and a second movable contact arranged for contacting one of the corresponding fixed contacts. The movable component disposed to sustain the movable ends of the movable contact strips, the movable component capable of either being latched with or released from the reset component to move between a first position where the first movable contacts are separated from the load contacts, and the second movable contacts are separated from the fixed contacts, and the movable contact strips are not electrically coupled to the reset contact, a second position where the first movable contacts are separated from the load contacts, and the second movable contacts are separated from the fixed contacts, and at least one of the movable contact strips is electrically coupled to the reset contact, and a third position where the first movable contacts make contact with the corresponding load contacts, and the second movable contacts make contact with the corresponding fixed contacts, and the movable contact strips are not electrically coupled to the reset contact. The tripping component is capable of latching the reset component with the movable component for the movable component to move to the third position upon detection of a reset request and releasing the reset component from the movable component for movable component to move to the first position upon detection of a fault condition.

32 Claims, 18 Drawing Sheets

GROUND FAULT CIRCUIT INTERRUPTER WITH REVERSE WIRING PROTECTION

This is a continuation-in-part of patent application Ser. No. 10/945,672, filed on Sep. 21, 2004.

FIELD OF THE INVENTION

The present invention relates to a ground fault circuit interrupter (GFCI) device for protecting an alternating current load circuit, and more particularly to a GFCI with reverse wiring protection.

BACKGROUND

With the increasing use of household electrical appliances, people demand that receptacles installed in their houses be capable of protecting them from serious injury when accidentally touched or other ground fault conditions occur. Thus, ground fault circuit interrupters are designed to break the electrical continuity upon detecting a ground fault condition occurring at an alternating current (AC) load.

Many electrical wiring devices including receptacles have a line side that is connectable to an electrical power supply, and a load side that is connectable to one or more loads and at least one conductive path between the line side and load side. When a person accidentally comes in contact with the line side of the AC load and an earth ground at the same time, a serious injury may occur because the human body forms another conductive path for the electrical current to flow through. There is a strong desire for electrical wiring devices that can break electric power supply to various loads such as household appliances and consumer electronic products.

The GFCI devices can detect a ground fault condition and break the electric power supply by employing a sensing transformer to detect an imbalance between the currents flowing in the phase (also known as "hot") and neutral conductive paths of the power supply. A ground fault condition happens when the current is diverted to the ground through another path such as a human body, that results in an imbalance between the currents flowing in the phase and neutral conductors. Upon detection of a ground fault condition, a breaker within the GFCI devices is immediately tripped to interrupt the electrical continuity and removes all power supply to the loads.

Some circuit interrupters, such as GFCI receptacles, have a user accessible load in addition to the line side and load side connections. Users can connect other household appliances to the power supply through plug entries on the receptacle. However, due to the similarity of line side and load side terminals, instances may occur where the line wires are connected to the load side connection and the load wires are connected to the line side connection. This is known as reverse wiring. When reverse wiring occurs, the GFCI devices usually do not provide ground fault protection to the user accessible load. It is a problem if there is no warning provided to an installer when the GFCI devices have reverse wiring. Thus, it is desired to design a GFCI device which can disable the reset function when the GFCI device has reverse wiring. Moreover, it is strongly desired that a GFCI does not even provide electricity to user accessible loads to better protect consumers when there is reverse wiring.

In addition, because of the high stability requirement of the GFCI devices' quality, it is also desired for GFCI devices to have a simpler design, less components so that they are easier to be assembled, installed, and correctly wired.

SUMMARY OF THE PREFERRED EMBODIMENTS

One embodiment of the invented circuit interrupter comprises a pair of fixed contact strips, a pair of load contact strips, a pair of movable contact strips, a reset component, a movable component, and a tripping component that contains a reset contact. Each of the fixed contact strips has a fixed contact. Each of the load contact strips has a load contact. Each of the movable contact strips has a fixed end and a movable end. Each movable end has a first movable contact arranged for contacting one of the corresponding load contacts and a second movable contact arranged for contacting one of the corresponding fixed contacts. The movable component disposed to sustain the movable ends of the movable contact strips, the movable component capable of either being latched with or released from the reset component to move between a first position where the first movable contacts are separated from the load contacts, and the second movable contacts are separated from the fixed contacts, and the movable contact strips are not electrically coupled to the reset contact, a second position where the first movable contacts are separated from the load contacts, and the second movable contacts are separated from the fixed contacts, and at least one of the movable contact strips is electrically coupled to the reset contact, and a third position where the first movable contacts make contact with the corresponding load contacts, and the second movable contacts make contact with the corresponding fixed contacts, and the movable contact strips are not electrically coupled to the reset contact. The tripping component is capable of latching the reset component with the movable component for the movable component to move to the third position upon detection of a reset request and releasing the reset component from the movable component for movable component to move to the first position upon detection of a fault condition.

In the embodiment, the reset component, the movable component, and the tripping component employ some elastic tubes such as springs to achieve a reset function and a trip function. By using elastic forces, the embodiment has the advantages of less manufacturing costs, convenient assembling, and a stable quality.

BRIEF DESCRIPTION OF THE DRAWINGS

A more complete understanding of the present invention can be obtained by reference to the detailed description of embodiments in conjunction with the accompanying drawings. These drawings depict only a typical embodiment of the invention and do not therefore limit its scope. They serve to add specificity and details, in which.

DETAILED DESCRIPTION

Patent application Ser. No. 10/945,672, filed on Sep. 21, 2004, by Ping Wang, is incorporated in its entirety.

Figure 1:
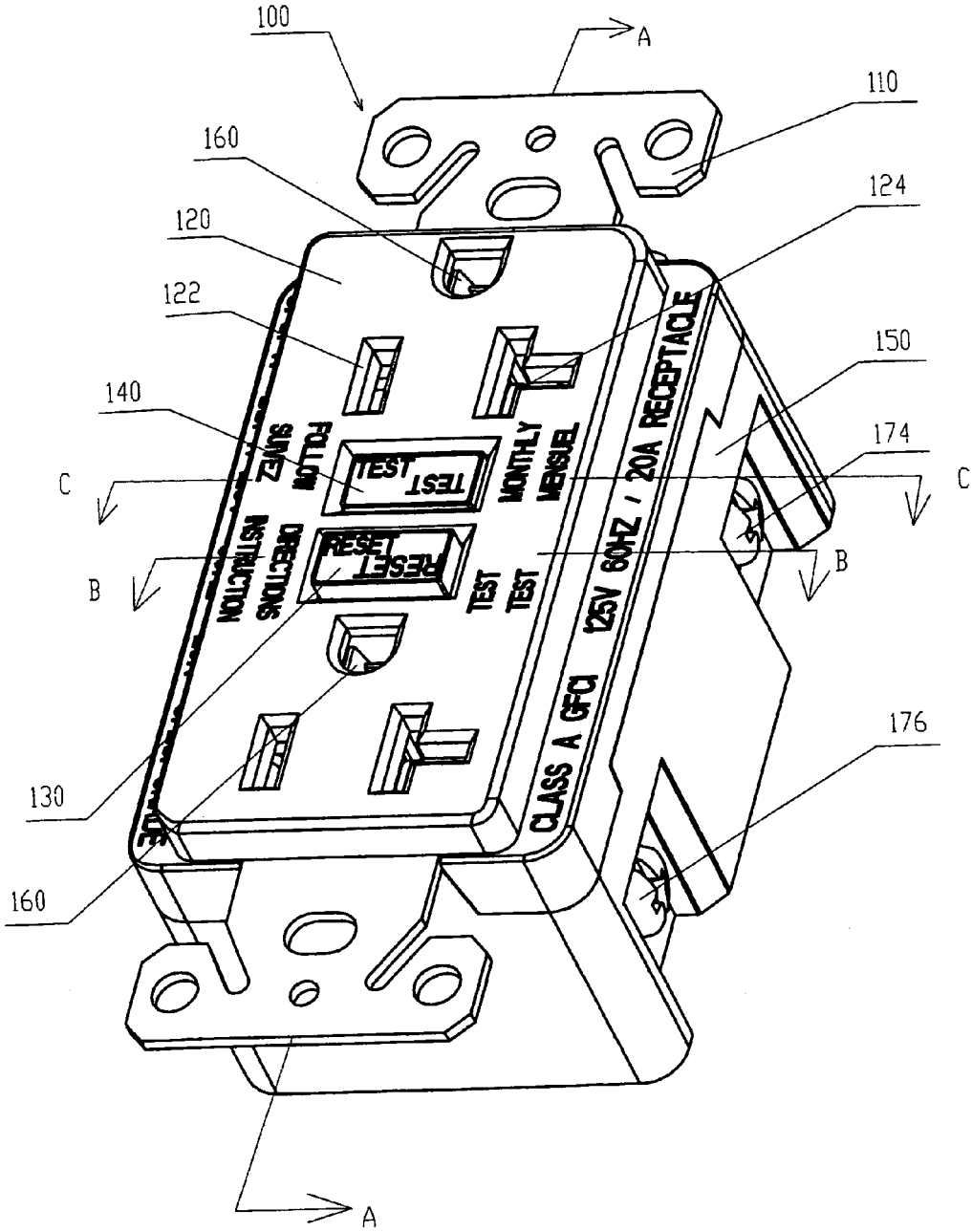
FIG. 1 is a perspective view of an exemplary embodiment of a current interrupter.
Figure 2:
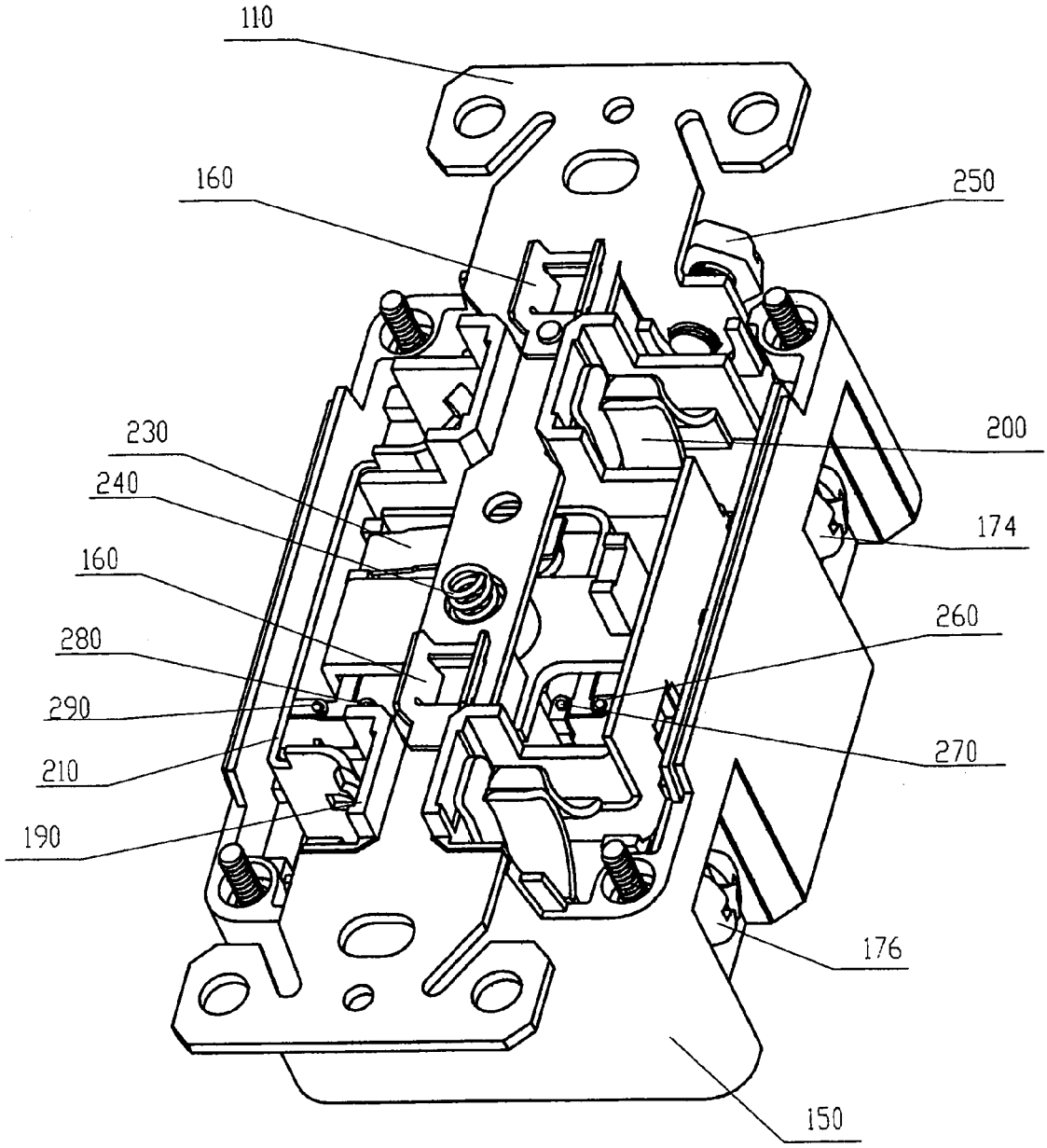
FIG. 2 is a perspective view of the current interrupter in FIG. 1 with a face portion removed, illustrating the internal configuration.

As shown in FIG. 1, an exemplary embodiment 100 of a ground fault current interrupter (GFCI) receptacle has a housing which comprises a face portion 120, a middle body 190 (shown in FIG. 2), and a rear portion 150. The face portion 120 has entry ports 122, 124 for receiving normal or polarized prongs of a male plug, as well as ground-prong-receiving openings 160 to accommodate a three-wire plug. The receptacle 100 contains a mounting strap 110 used to fasten the receptacle to a junction box. As shown in FIG. 2, the mounting strap 110 has a threaded opening to receive a ground screw 250 for connecting to an external ground wire.

A reset button 130 extends through an opening in the face portion 120 of the housing. The reset button 130 is used to activate a reset operation which re-establishes the electrical continuity in open conductive paths. A test button 140 extends through an opening in the face portion 120 of the housing. The test button 140 is used to break the electrical continuity in close conductive paths by simulating a fault condition.

Figure 15:
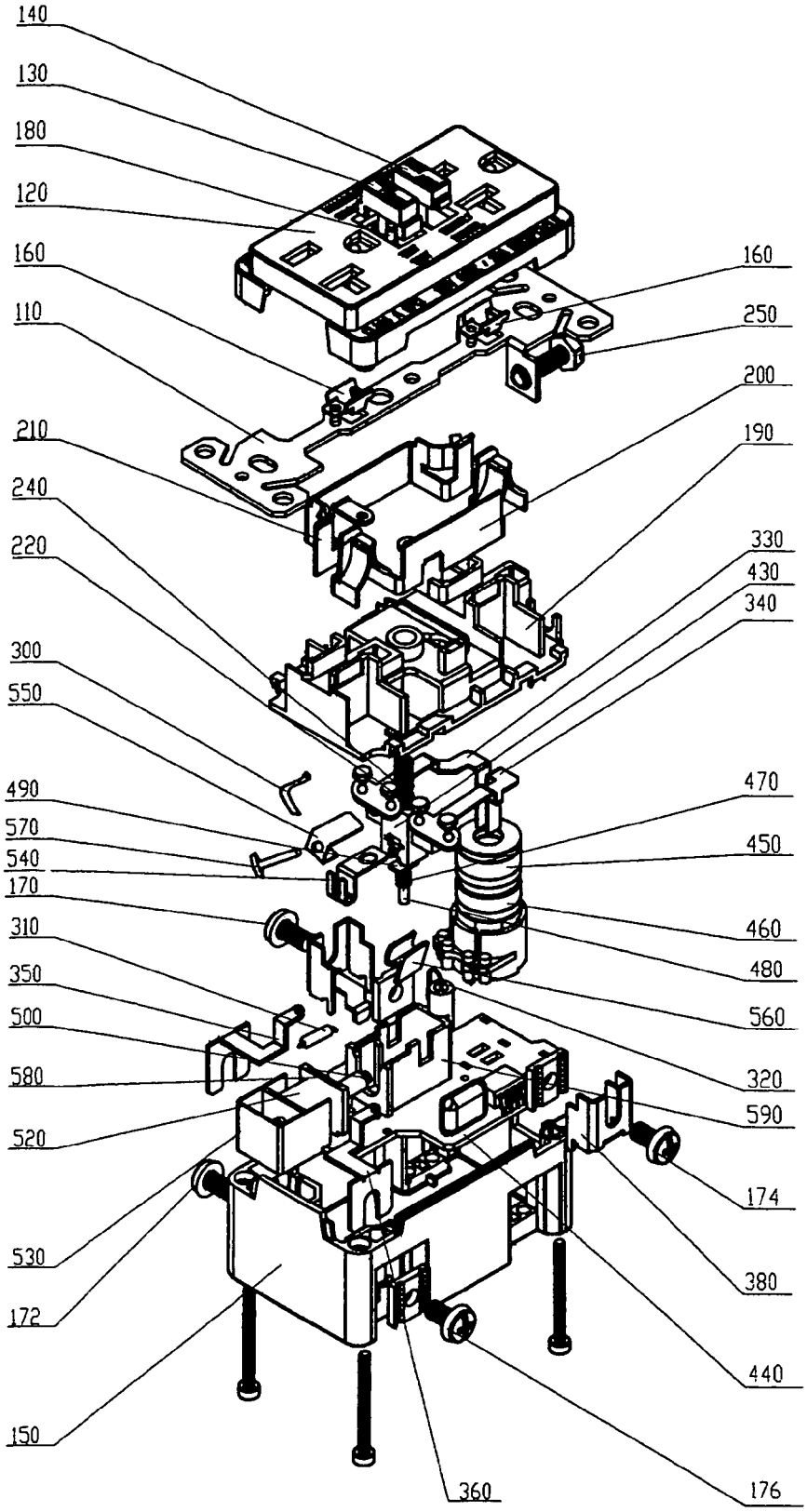
FIG. 15 is an exploded view of the current interrupter in FIG. 1.

As shown in FIGS. 1 and 15, electricity connects to the GFCI receptacle 100 through binding screws 170, 172, 174, and 176 where the binding screw 170 is a line phase connection, the binding screw 174 is a line neutral connection, the binding screw 172 is a load phase connection, and the binding screw 176 is a load neutral connection. In addition to binding screws, people in the art will appreciate other types of wiring terminals such as set screws, pressure clamps, pressure plates, push-in type connections, pigtails, and quick-connect tabs.

Figure 3A:
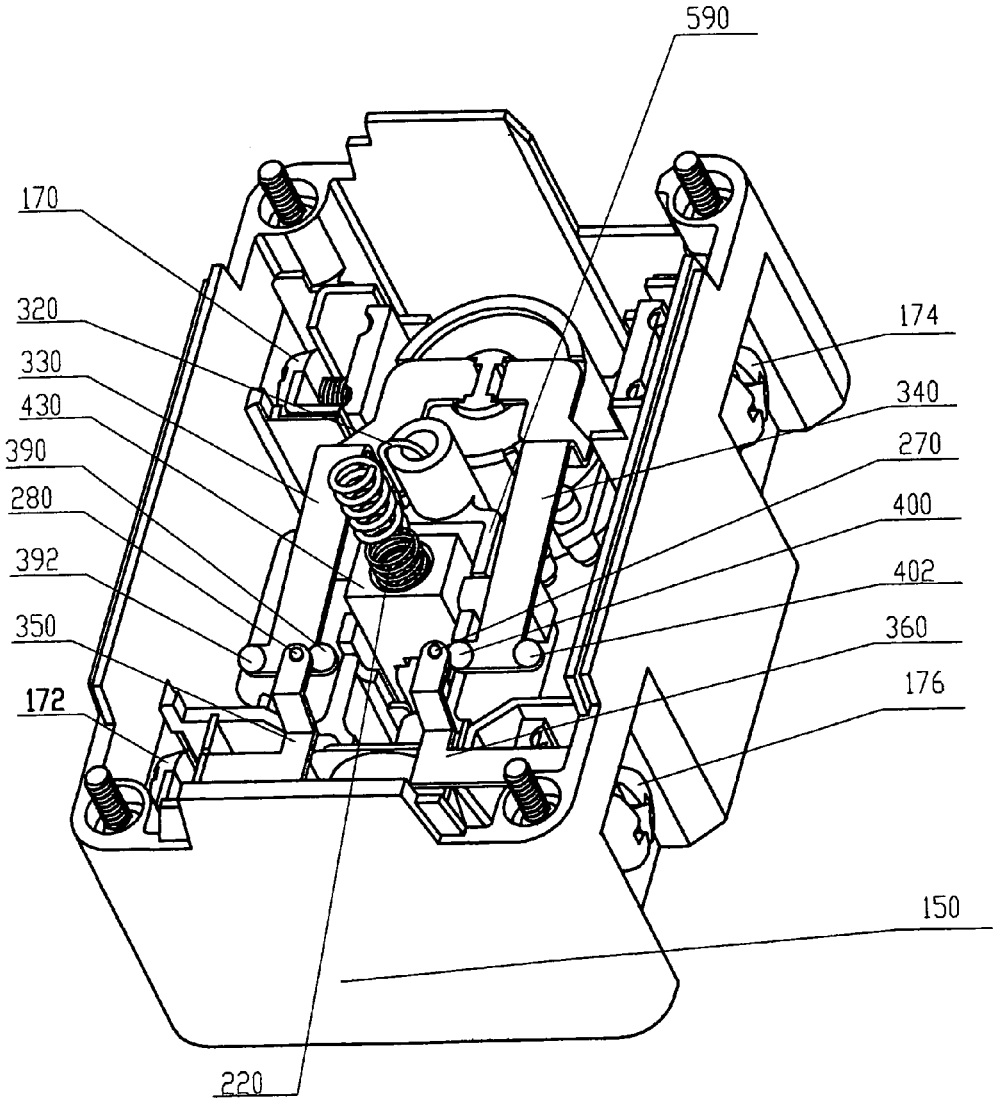
FIG. 3A is a perspective view of the current interrupter in FIG. 2 with a mounting strap and a middle body removed, further illustrating the internal configuration.
Figure 6:
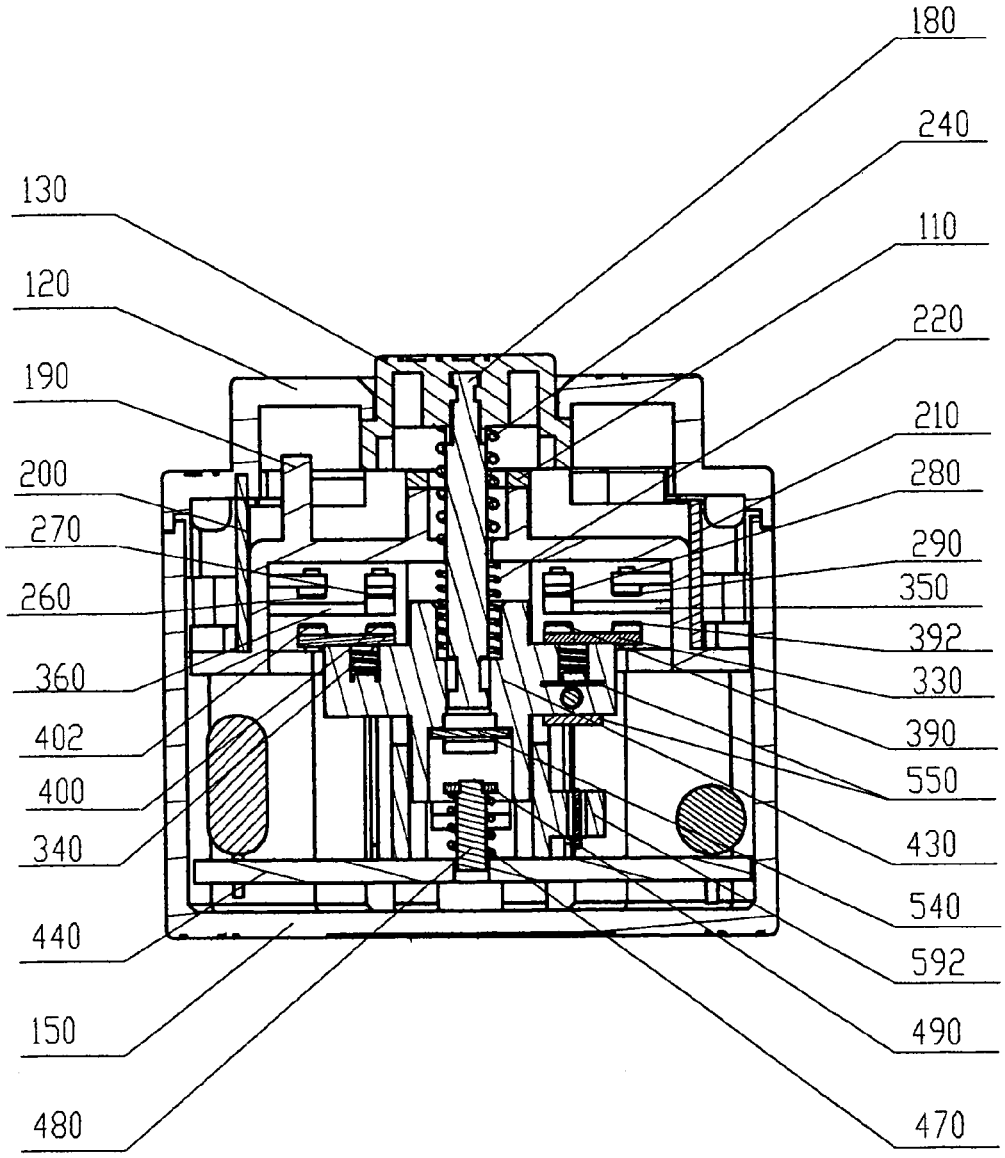
FIG. 6 illustrates a cross-sectional view of the current interrupter in FIG. 1 along the BB line in a tripped condition.
Figure 7:
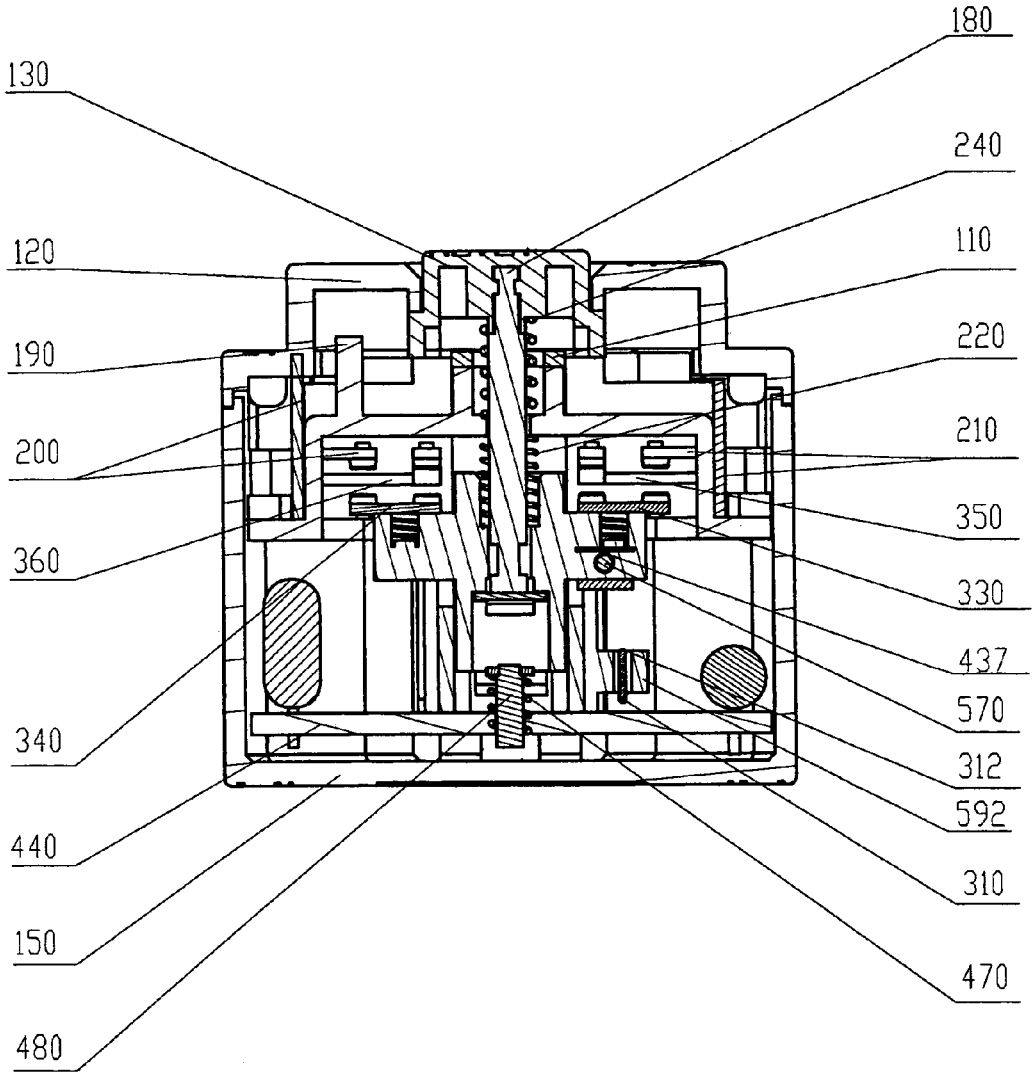
FIG. 7 illustrates a cross-sectional view of the current interrupter in FIG. 1 along the BB line in a transient condition when a reset button is pressed.
Figure 8:
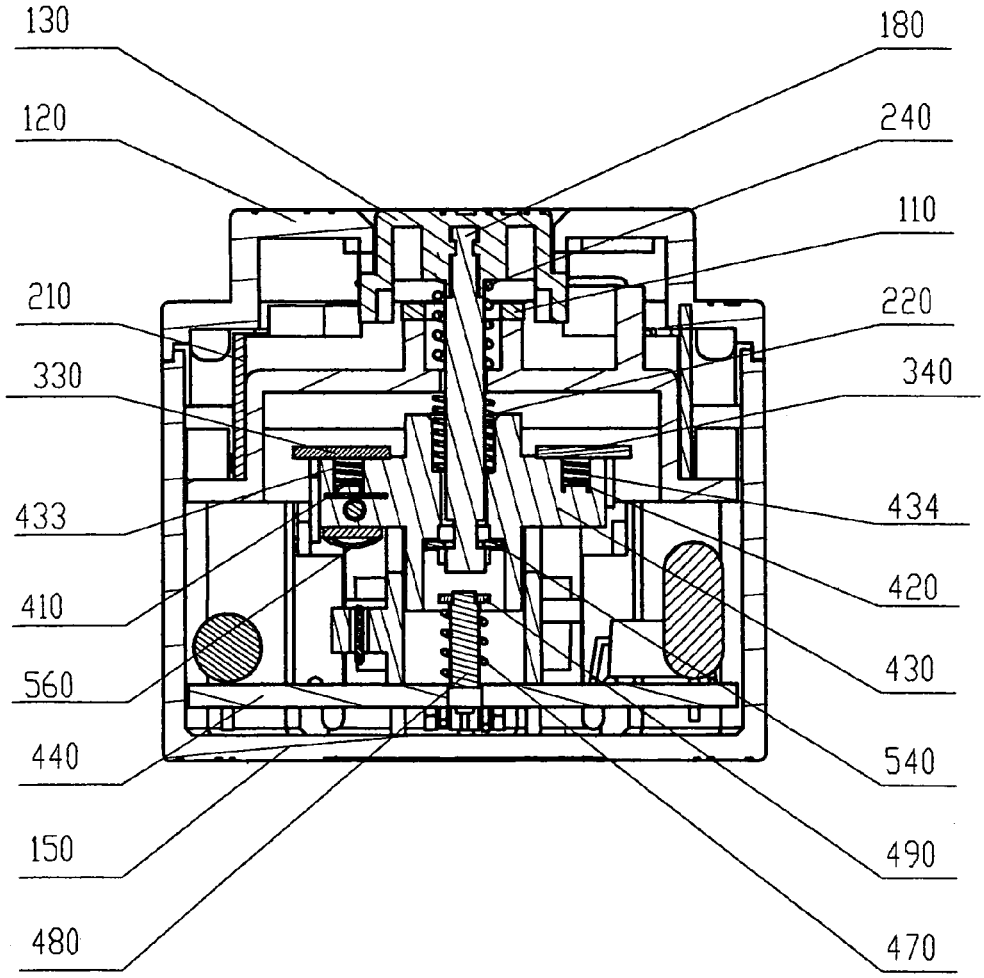
FIG. 8 illustrates a cross-sectional view of the current interrupter in FIG. 1 along the opposite direction of BB line in a reset condition.
Figure 9:
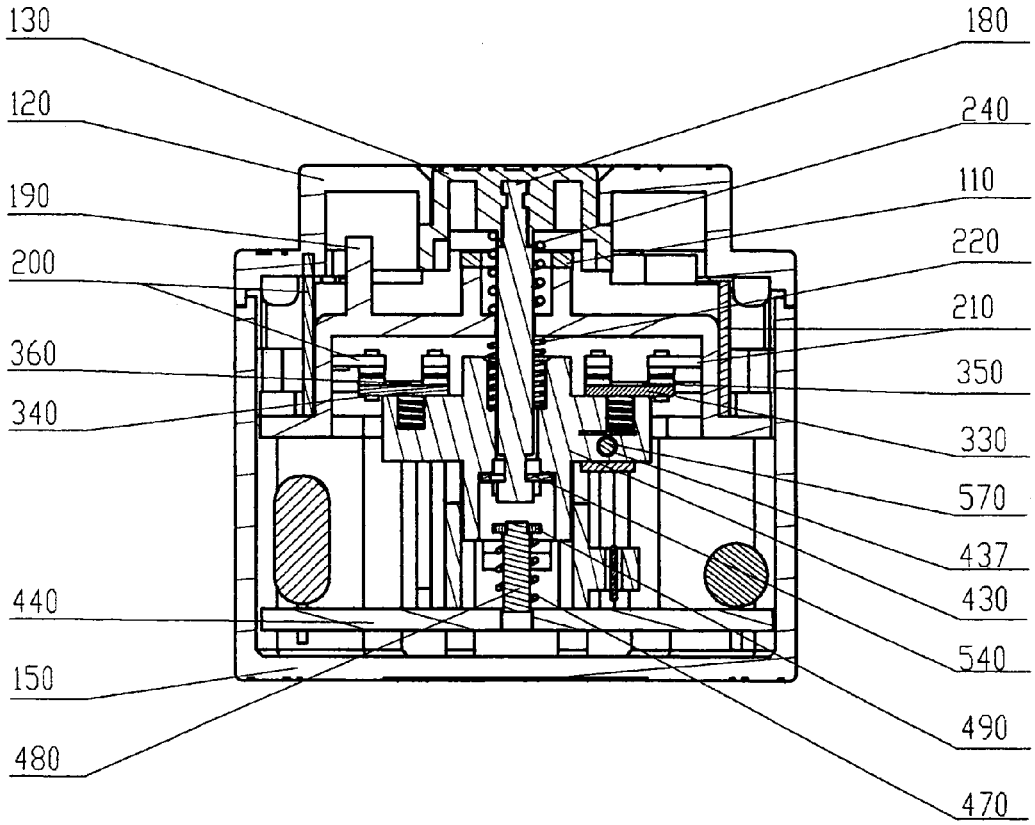
FIG. 9 illustrates a cross-sectional view of the current interrupter in FIG. 1 along the BB line in a reset condition.
Figure 10:
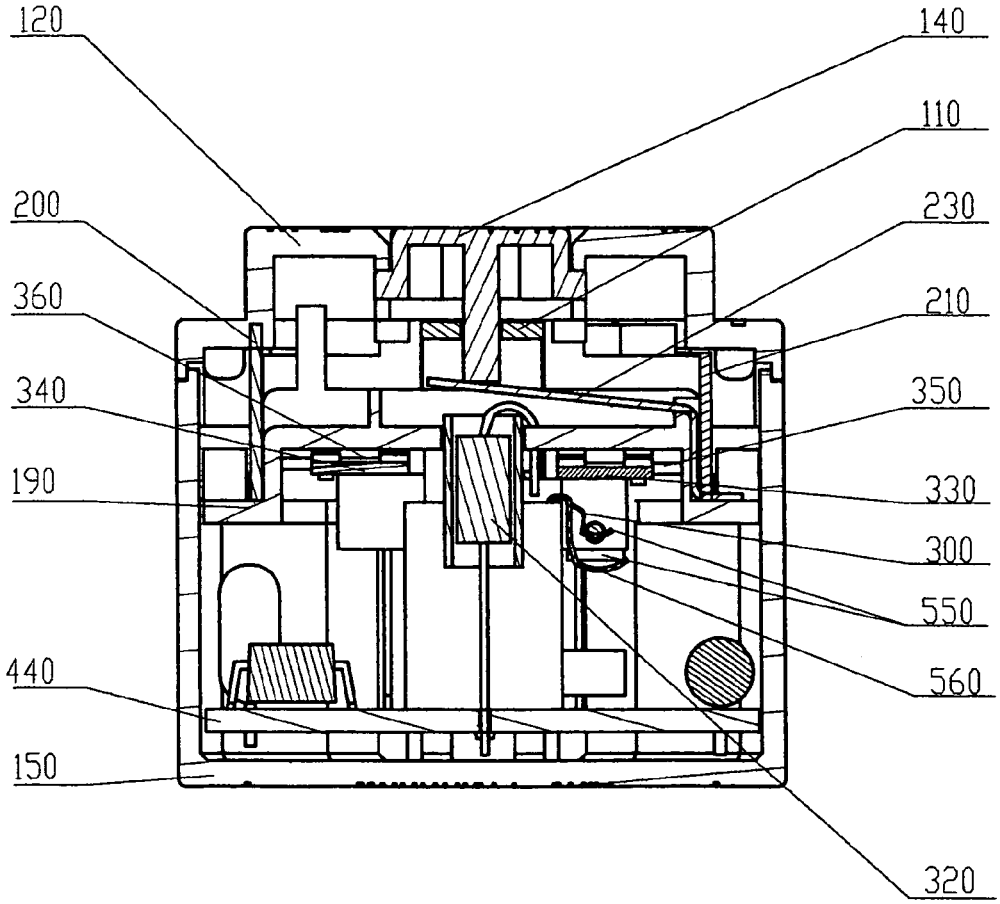
FIG. 10 illustrates a cross-sectional view of the current interrupter in FIG. 1 along the CC line with a test component.
Figure 11:
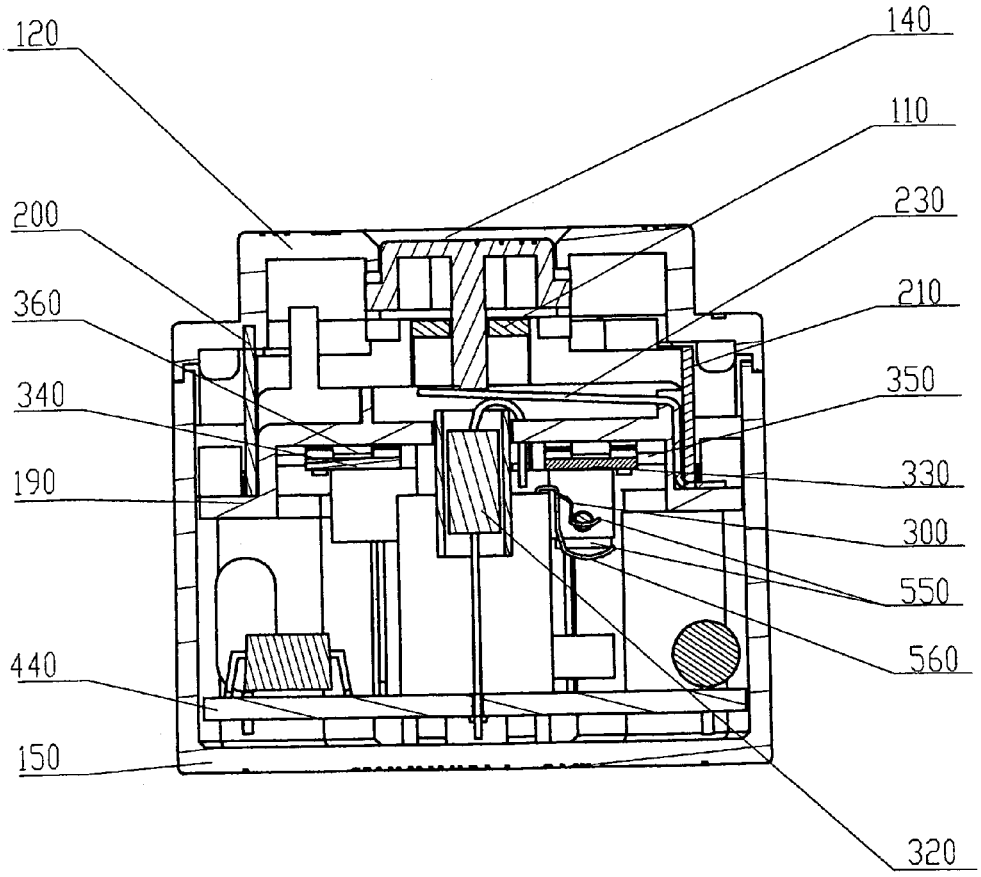
FIG. 11 illustrates a cross-sectional view of the current interrupter in FIG. 1 along the CC line in a transient condition when a test button is pressed.
Figure 12:
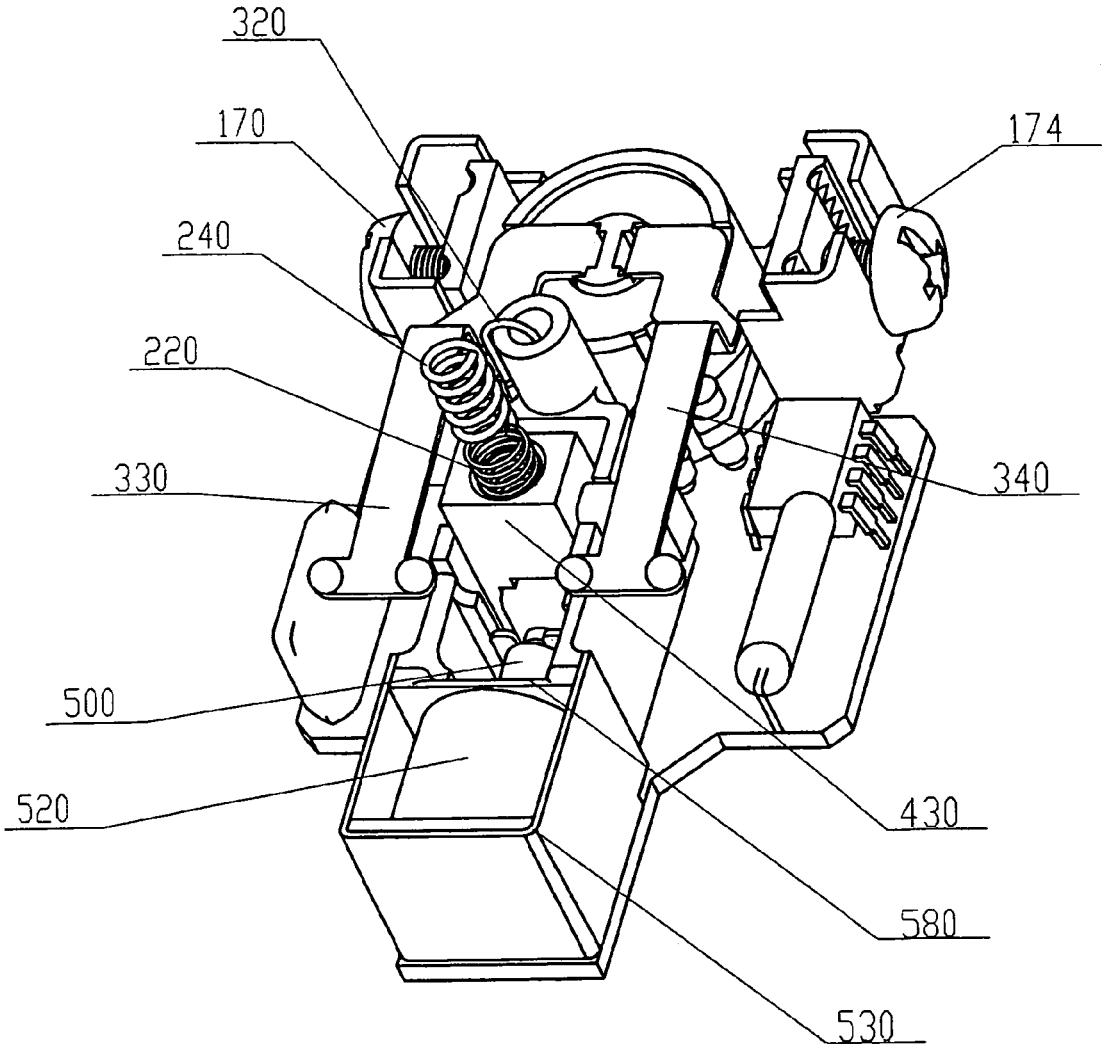
FIG. 12 is a perspective view of the current interrupter in FIG. 3 with a rear portion removed.

As shown in FIGS. 2, 3, and 6, the conductive path between the line neutral connection 174 and the load neutral connection 176 comprises a right movable contact strip 340 with one end electrically coupled to the line neutral connection 174 and the other end movable to establish and break the electrical continuity, a first right movable contact 400 mounted onto the left movable end of the right movable contact strip 340, a right load contact strip 360 electrically coupled to the load neutral connection 176, and a right load contact 270 mounted onto the right load contact strip 360. A user accessible load neutral connection contains binding terminals capable of engaging a prong of a male plug inserted therebetween. The conductive path between the line neutral connection 174 and the user accessible load neutral connection comprises a right movable contact strip 340 with one end electrically coupled to the line neutral connection 174 and the other end movable to establish and break the electrical continuity, a second right movable contact 402 mounted onto the right movable end of the right movable contact strip 340, a right fixed contact strip 200 electrically coupled to the binding terminals, and a right fixed contact 260 mounted onto the right fixed contact strip 200.

Similarly, the conductive path between the line phase connection 170 and the load phase connection 172 comprises a left movable contact strip 330 with one end electrically coupled to the line phase connection 170 and the other end movable to establish and break the electrical continuity, a first left movable contact 390 mounted onto the right movable end of the left movable contact strip 330, a left load contact strip 350 electrically coupled to the load phase connection 172, and a left load contact 280 mounted onto the left load contact strip 350. A user accessible load phase connection contains binding terminals capable of engaging a prong of a male plug inserted therebetween. The conductive path between the line phase connection 170 and the user accessible load phase connection comprises a left movable contact strip 330 with one end electrically coupled to the line phase connection 170 and the other end movable to establish and break the electrical continuity, a second left movable contact 392 mounted onto the left movable end of the left movable contact strip 330, a left fixed contact strip 210 electrically coupled to the binding terminals, and a left fixed contact 290 mounted onto the left fixed contact strip 210.

As shown in FIGS. 1–14, the GFCI receptacle 100 contains the movable contact strips 330, 340, the fixed contact strips 200, 210, the load contact strips 350, 360, a reset component, a test component, a movable component, and a tripping component. A protruding contact 550 (shown in FIG. 14) is electrically coupled to the left movable contact strip 330 for the reset operation. When the reset button 130 of the reset component is pressed, the reset component moves down and causes the left movable contact strip 330 to electrically connect to a reset resistor 310 through the protruding contact 550. The tripping component is then activated to latch the reset component with the movable component. When the reset button 130 is released, the reset component moves up and brings the movable component up together. The movable component further pushes the movable ends of the movable contact strips 330, 340 up to a position where first movable contacts 390, 400 maintain a good contact with corresponding load contacts 280, 270 and where second movable contacts 392, 402 maintain a good contact with corresponding fixed contacts 290, 260. Accordingly, the reset operation re-establishes the electrical continuity between the line end and the load end as well as between the line end and the user accessible load end. When the test button 140 is pressed, the test component activates the tripping component to release the reset component from the movable component. The movable component moves down and causes the movable contacts 390, 392, 400, 402 to separate from the fixed contacts 260, 290 and the load contacts 270, 280. Accordingly, the test operation simulates a fault condition to break the electrical continuity.

The reset component comprises the reset button 130, a reset shaft 180, and a reset spring 240. One end of the reset shaft 180 is molded into the underside of reset button 130 and the other end extends through the middle body 190 into the movable component. The reset spring 240 surrounds an upper portion of the reset shaft 180 and is partially disposed in a cup-shape portion of the middle body 190. Thus, one end of the reset spring 240 props up the reset button 130 and the other end presses onto an upper surface of the middle body 190. In other words, the reset spring 240 is restricted between the reset button 130 and the middle body 190.

The movable component mainly disposed under the reset component comprises a movable assembly 430 and a latching plate 540. The movable assembly 430 has a left sustaining portion 431 and right sustaining portion 432 (shown in FIG. 14) extending under the movable ends of the movable contact strips 330, 340, respectively. As a result, when the movable assembly 430 moves up, the movable ends of the movable contact strips 330, 340 are brought up to a position so that the first movable contacts 390, 400 maintain a good contact with corresponding load contacts 280, 270 and the second movable contacts 392, 402 maintain a good contact with corresponding fixed contacts 290, 260. However, if the movable ends of the left movable contact strip 330 and the right movable contact strip 340 are not precisely on the same horizontal level, the contacts between left contacts (390 and 280, 392 and 290) and the contacts between right contacts (400 and 270, 402 and 260) may not be equally good. In one embodiment as shown in FIGS. 6–9, supporting springs 410, 420 are respectively disposed in spring cavities 433, 434 on the sustaining portions 431, 432 to adjust and improve these contacts. Covering plates (not shown) may be disposed on the top of the springs to electrically insulate the supporting springs 410, 420 from the movable contact strips 330, 340. The supporting springs 410, 420 respectively provide a separate elasticity to the movable contact strips 330, 340 so that both right contacts and left contacts can maintain a good contact even when they are in a slightly different horizontal level.

Figure 14:
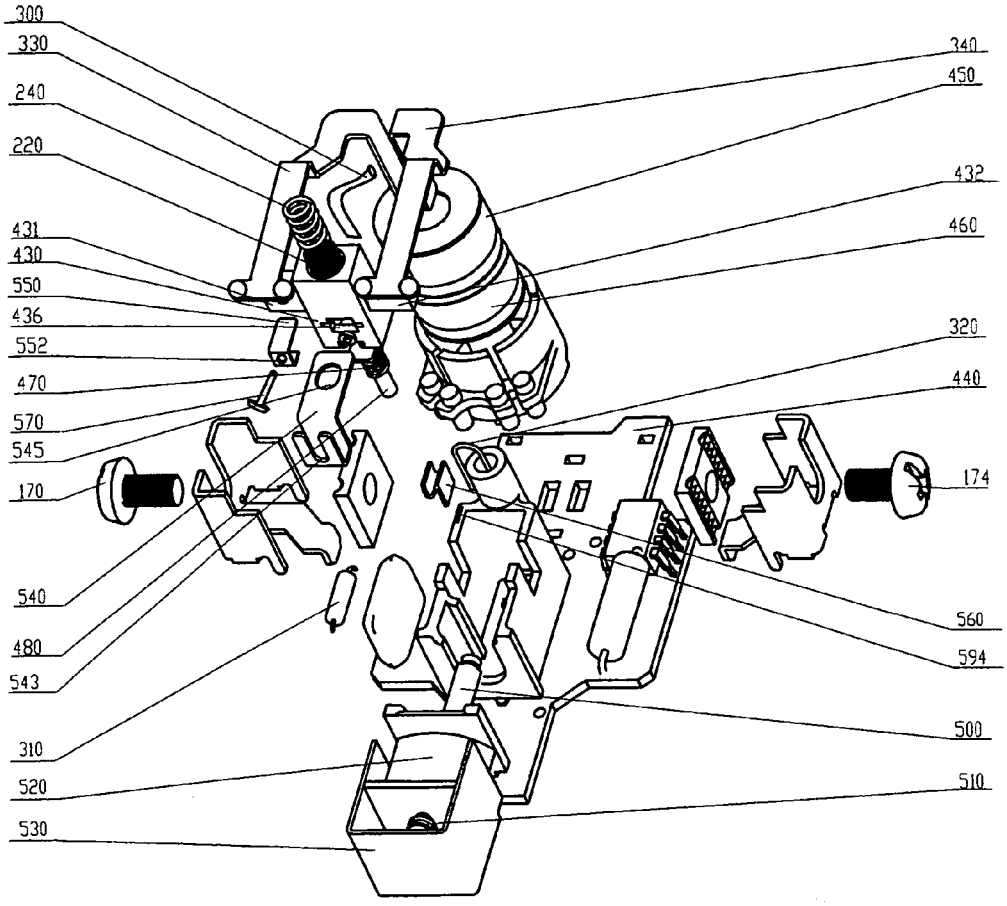
FIG. 14 is an exploded view of the current interrupter in FIG. 12.

As shown in FIG. 14, the movable assembly 430 has a cavity, a middle spring 220, a pair of latching slots 436, a reverse shaft 480, and a reverse spring 470. The cavity with an opening on the top accommodates a lower portion of the reset shaft 180. An upper portion of the cavity is wider so that the middle spring 220 can partially sit in and surround the lower portion of the reset shaft 180. As a result, the middle spring 220 is restricted between a lower surface of the middle body 190 and the inner wall of the cavity. People in the art understand that under certain circumstances the middle spring 220 is not necessary to achieve the intended function. The reverse shaft 480 has one end attached to and under a lower plate 490 of the movable assembly 430 and the other end penetrating into a circuit board 440. The reverse spring 470 surrounds the reverse shaft 480 and is restricted between the lower plate 490 of the movable assembly 430 and the circuit board 440. The pair of latching slots 436 are disposed on both side walls of the movable assembly 430 allowing the latching plate 540 to extend through the movable assembly 430.

The latching plate 540 has a latching portion with a latching hole 545 and a clasp portion with a clasp opening 543. The latching portion extends through the movable assembly 430 via the latching slots 436. The latching hole 545 is disposed on the latching portion so that the reset shaft 180 can penetrate the latching hole 545 and latches with the latching plate 540 when the GFCI receptacle 100 is in a reset condition. The clasp opening 543 is arranged to allow the latching plate 540 to be able to move up and down while remaining to be clasped with the tripping component. In this embodiment, the clasp portion has a U-shaped opening 543.

Figure 4:
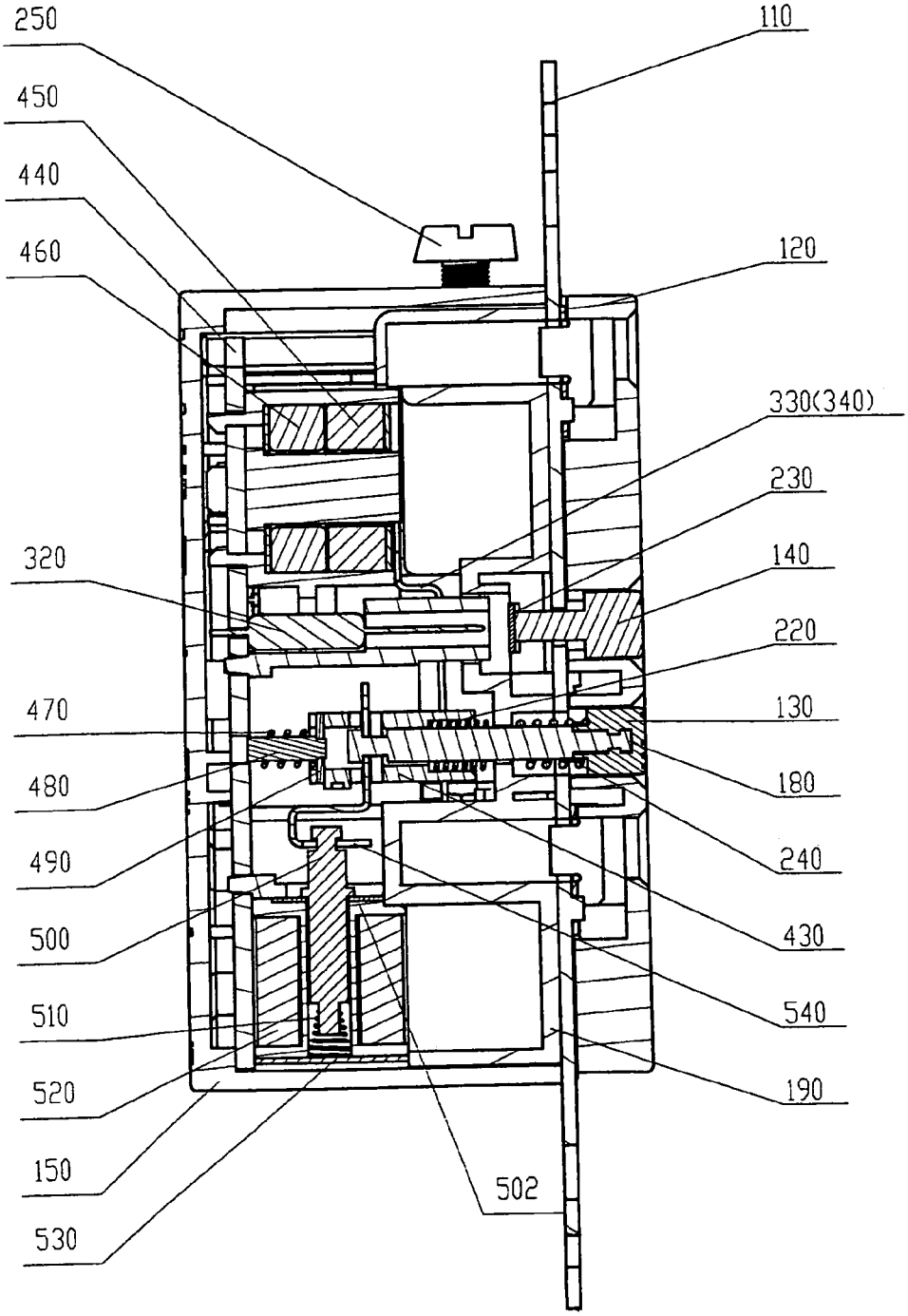
FIG. 4 illustrates a cross-sectional view of the current interrupter in FIG. 1 along the AA line in a reset condition.

The tripping component comprises a trip shaft 500, a trip spring 510, an electromagnetic unit, and a control circuit. The electromagnetic unit contains a trip coil 520, a shield plate 580 disposed right before the trip coil 520, and a metal shield 530. The metal shield 530 covers at least two sides of the trip coil 420 and is abutted against one side of the rear portion 150. The trip shaft 500 has a first end clasped with the U-shaped clasp opening 543 in the clasp portion of the latching plate 540 and a second end disposed inside the trip coil 520. A portion of the trip spring 510 surrounds a narrower portion of the trip shaft 500 at its second end. The remaining portion of the trip spring 510 forms a space for the movement of the trip shaft 500. The trip spring 510 is restricted between the shield metal 530 and a constricting surface of the trip shaft 500. The trip spring 510 can be in a conical shape or in a cylinder shape. When activated by the control circuit, the electromagnetic unit pulls the trip shaft 500 which in turn pulls the latching plate 540 so that the reset shaft 180 can be latched with or released from the latching hole 545. To control the moving distance of the trip shaft 500, the trip shaft may have a protruding portion 502 located before the shield plate 580 (as shown in FIG. 4) to cease the movement when the protruding portion 502 touches the shield plate 580. Similarly, the movable assembly accommodation base 590 may have a blocking portion extended before or after the latching plate 540 to control the moving distance of the trip shaft 500.

Figure 13:
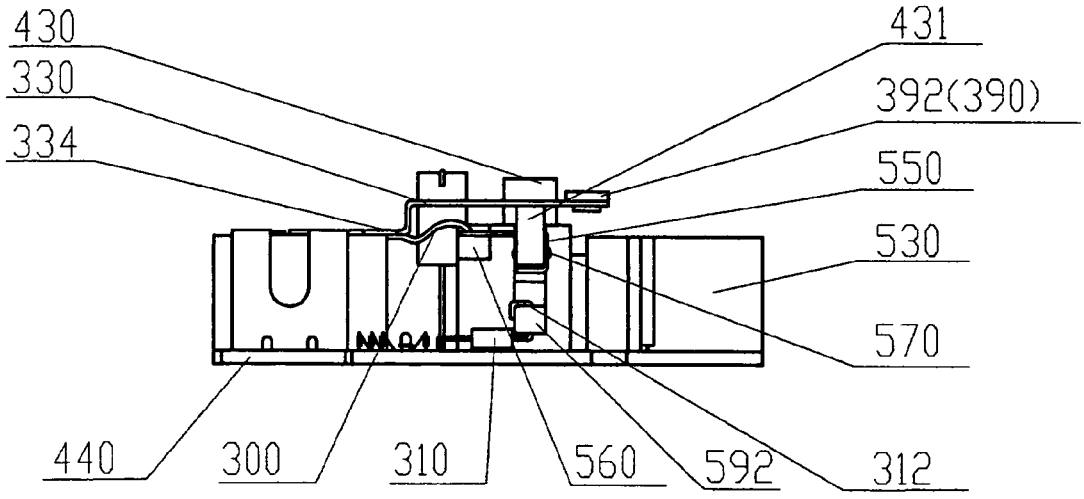
FIG. 13 is left-to-right side view of the current interrupter in FIG. 12.

The control circuit activates the electromagnetic unit upon detecting a ground fault condition, a test request, and a reset request. The control circuit has a reset resistor 310, a reset contact 312, a test resistor 320, a sensing coil 460, and a neutral coil 450. The sensing coil 460 and the neutral coil 450 detect a fault condition. The reset contact 312 is disposed to contact with the protruding contact 550 to activate the reset operation. In one embodiment, the reset contact 312 is a portion of the reset resistor 310. As shown in FIG. 13, the reset contact 312 is disposed on the top of a fixing stand 592 which is a portion of the movable assembly accommodation base 590. In another embodiment, the reset contact 312 is a conductive strip disposed to be electrically coupled to the reset resistor 310. When the reset button 130 is pressed down to cause the protruding contact 550 to contact with the reset contact 312, the left movable contact strip 330 is electrically coupled to the reset resistor 310 so that a close circuit is formed and a diverted current is generated. Accordingly, the control circuit activates the electromagnetic unit to perform the reset operation. Similarly, the control circuit activates the electromagnetic unit when a test strip 230 is pressed down to contact a test resistor 320 and to form a close circuit.

Figure 5:
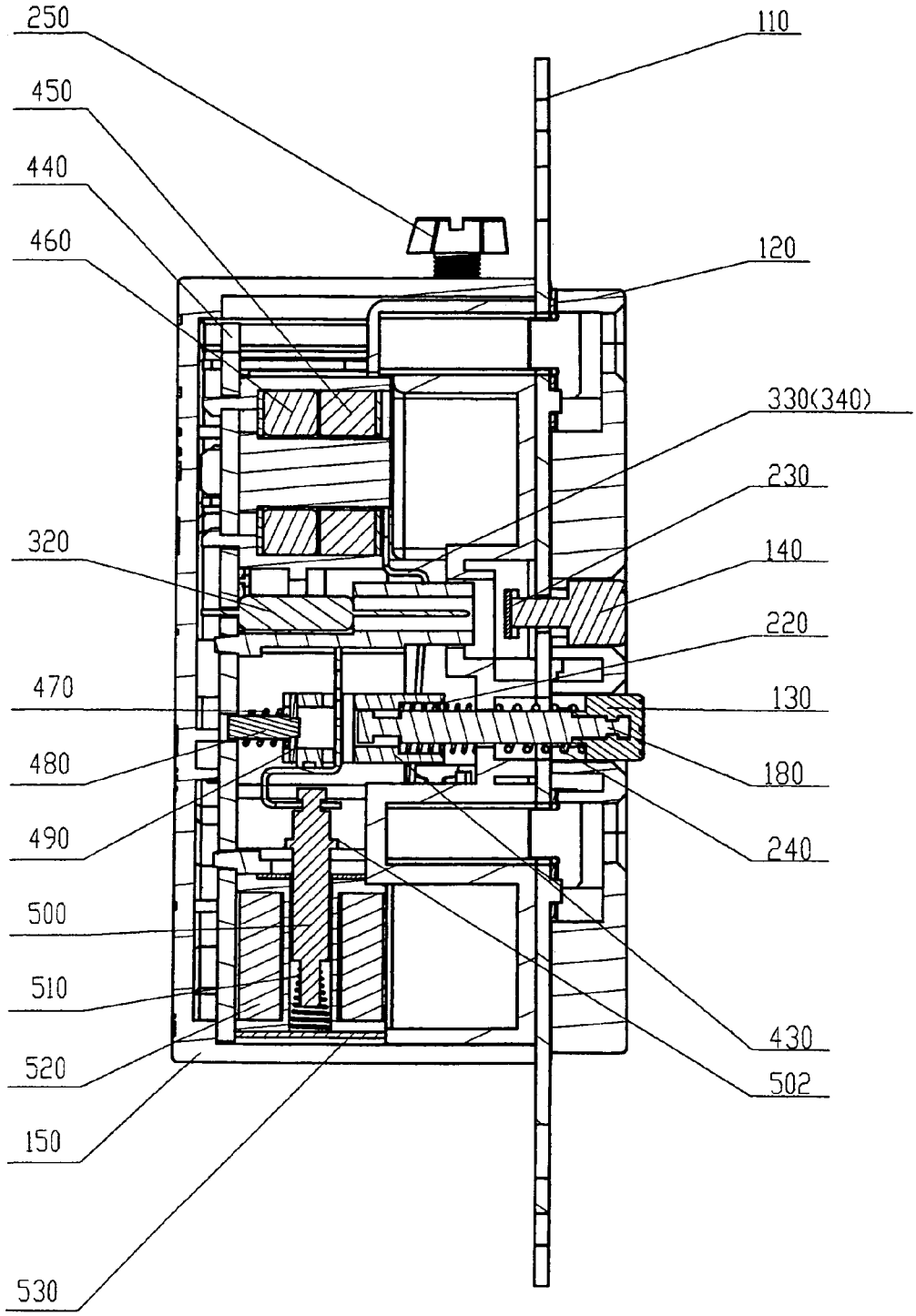
FIG. 5 illustrates a cross-sectional view of the current interrupter in FIG. 1 along the AA line in a tripped condition.

The GFCI receptacle 100 is originally stable at a trip condition as shown in FIGS. 5 and 6. The movable component is at a first position where movable ends of the movable contact strips 330, 340 stay on the sustaining portions 431, 432 of the movable assembly 430 and are separated from the fixed contact strips 200, 210 and load contact strips 350, 360. The left movable contact strip 330 is not electrically coupled to the reset resistor 310. The movable assembly 430 is at a stabilized position due to the balance among the reset spring 240, the middle spring 220, and the reverse spring 470.

After the GFCI receptacle 100 is correctly wired, the reset button 130 is pressed to establish the electrical continuity in the conductive paths. When the reset button 130 is pressed, the reset shaft 180 moves down to push onto a surface of the latching plate 540. The latching plate 540 brings the movable assembly 430 to move down. The movable ends of the movable contact strips 330, 340 move down due to their own elasticity. The left movable contact strip 330 is electrically coupled to the reset resistor 310 to form a close circuit and to generate a reset request. In one embodiment, the protruding contact 550 is electrically coupled to the left movable contact strip 330 through a connecting strip 300. The protruding contact 550 is attached to the left sustaining portion 431 of the movable assembly 430 by inserting a rivet 570 through a fastening hole 552 on the protruding contact 550 and a corresponding hole 437 on the left sustaining portion 431 of a movable assembly 430. People with ordinary skills in the art will appreciate other ways to attach the protruding contact 550 to the left sustaining portion 431 of the movable assembly 430. The connecting strip 300 connects the protruding contact 550 and a connecting portion 334 of the left movable contact strip 330. The connecting strip 300 may comprise copper. Materials such as a soft copper cord or a copper strip can be used. In another embodiment, the left movable contact strip 330 contains a protruding contact 550. The movable assembly 430 is at a transient second position where the movable ends of the movable contact strips 330, 340 are separated from the fixed contact strips 200, 210 and load contact strips 350, 360. At the same time, the left movable contact strip 330 is electrically coupled to the reset resistor 310, either directly or indirectly, to activate a reset operation.

Because of the closed circuit resulting from the electric connection, the control circuit activates the electromagnetic unit to pull the trip shaft 500. The trip shaft 500 then pulls the latching plate 540 by overcoming friction force between the reset shaft 180 and the latching plate 540 as well as the elastic force from the pressed trip spring 510. When the latching hole 545 moves to a position right under the reset shaft 180, a head portion of the reset shaft 180 penetrates the latching hole 545. At the moment, because the pressure given onto the latching plate 540 by the reset shaft 180 vanishes, the pressed reverse spring 470 bounces back to move the movable assembly 430 up. The left sustaining portion 431 of the movable assembly 430 pushes the left movable contact strip 330 up. As a result, the protruding contact 550 separates from the reset contact 312. Because of the open circuit resulting from the separation, the control circuit inactivates the electromagnetic unit to cease the pulling force. The pressed trip spring 510 then bounces back to push the latching plate 540 and causes a neck portion of the reset shaft 180 to latch with the latching hole 545.

When the reset button is released, the pressed reset spring 240 bounces back to move up the reset shaft 180. The reset shaft 180 brings up the movable assembly 430 through the latching plate 540 that latches with the reset shaft 180. Overcoming the elastic forces from the pressed middle spring 220 and the movable contact strips 330, 340, the movable assembly 430 with the sustaining portions 431, 432 pushes the movable ends of the movable contact strips 330, 340 to a position where the first movable contacts 390, 400 maintain a good contact with the respective load contacts 280, 270 and the second movable contacts 392, 402 maintain a good contact with the respective fixed contacts 290, 260. The movable assembly 430 is then at a third position when the GFCI receptacle 100 is at a reset condition.

The receptacle 100 may include a resistive strip 560 disposed in a way to cause a transient blocking effect when the reset button 130 is pressed down to initiate a reset operation. In one embodiment, the resistive strip 560 is attached to a movable assembly accommodation base 590 and extends under the left sustaining portion 431 of movable assembly 430 by inserting a portion of the resistive strip 560 into an insertion slot 594 on the base 590. When the reset button 130 is pressed, the reset shaft 180 moves down to push onto the surface of the latching plate 540. The latching plate 540 brings the movable assembly 430 to move down. At this moment, the resistive strip temporarily blocks the movement of the movable assembly 430. After the reset button 130 is pressed with more force, the movable assembly 430 overcomes the elastic force of the resistive strip 560 and continues to move down. In one embodiment, the resistive strip 560 comprises stainless steel and is in an upwardly curved shape. People in the art understand that other material with good elasticity can be used and the resistive strip 560 can be made in other shapes. In addition, to increase the resistivity, a spring may be disposed under the resistive strip 560 and be supported by a stand extended from the movable assembly accommodation base 590. Although the resistive strip 560 may comprise metal, it does not form any part of the control circuit or conductive paths. The resistive strip 560 can prevent children from accidentally pressing down the reset button 130 and activating the reset operation.

Figure 3B:
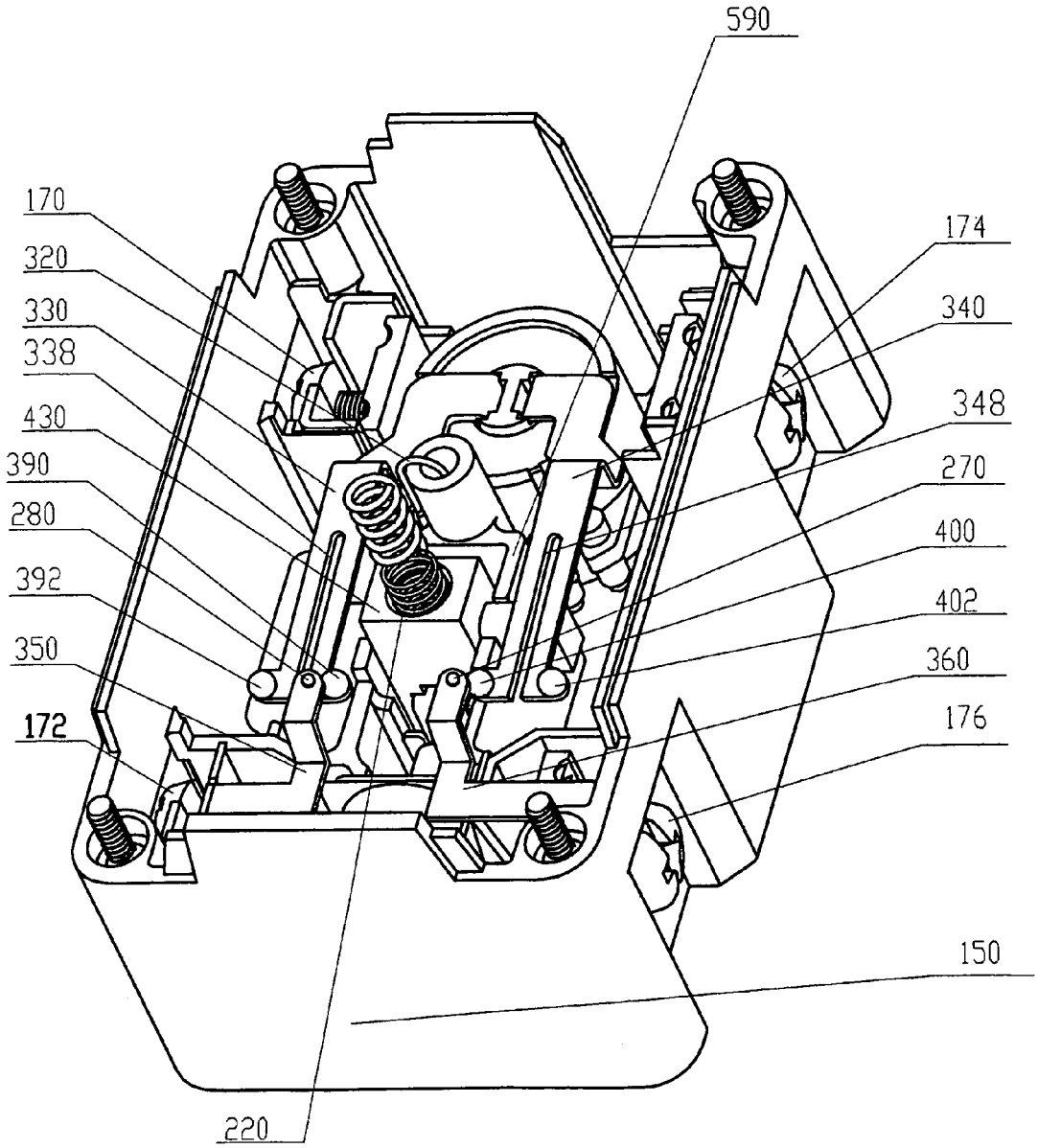
FIG. 3B is a perspective view of the current interrupter in FIG. 3A with split movable ends of the movable contact strips.

As another embodiment shown in FIG. 3B, the movable ends of movable contact strips 330, 340 can be split into two sub-strips from an appropriate place with first movable contacts 390, 400 and second movable contacts 392, 402 respectively located on each of the sub-strip. For example, the first left movable contact 390 is located on an inner sub-strip of the left movable contact strip 330; the second left movable contact 392 is located on an outer sub-strip of the left movable contact strip 330; the first right movable contact 400 is located on an inner sub-strip of the right movable contact strip 340; the second right movable contact 402 is located on an outer sub-strip of the right movable contact strip 340. People in the art understand that the shape of the movable contacts strips 330, 340, the load contact strips 350, 360, and the fixed contact strips 200, 210, and the location of these contact strips may vary as long as four contact pairs, the first left movable contact 390 corresponding to the left load contact 280, the second left movable contact 392 corresponding to the left fixed contact 290, the first right movable contact 400 corresponding to the right load contact 270, and the second right movable contact 402 corresponding to the right fixed contact 260 maintain a good contact when in a reset condition.

In addition, people in the art will appreciate that other elastic materials such as elastic tubes can be used to replace the reset spring 240, the middle spring 220, the reverse spring 470, and the trip spring 510. In this embodiment, the load contacts 280, 270 and the fixed contacts 290, 260 have a flat contact surface and the first movable contacts 390, 400 and the second movable contacts 392, 402 have a protruding contact surface, such as a hemispherical shape. In this embodiment, all contacts comprise copper alloy and the contacting surfaces of all contacts are coated with silver alloy. People in the art understand that the load contacts 280, 270, the fixed contacts 290, 260, the first movable contacts 390, 400, and the second movable contacts 392, 402 can be made in other shapes and by other materials. In this embodiment, the reset shaft 180 and the reverse shaft 480 comprise steel. The trip shaft 500 comprises iron. People in the art understand other materials can be used to make the reset shaft 180, the reverse shaft 480, and the trip shaft 500. In this embodiment, when activated by the control circuit, the electromagnetic unit pulls the trip shaft 500 so that the reset shaft 180 can be latched with or released from the latching hole 545. However, people in the art appreciate that when activated by the control circuit, the electromagnetic unit can also push the trip shaft 500 to achieve the same results.

If the GFCI receptacle 100 has a reverse wiring, the control circuit is not supplied with electricity to activate the electromagnetic unit when the protruding contact 550 contacts the reset contact 312 and the reset function is disabled. In other words, when the GFCI receptacle 100 is in a trip condition, the control circuit is connected to the line side of the GFCI receptacle 100 only and is not connected to the load side. As a result, if the line wires are connected to the load side of the GFCI receptacle 100, no power supply is provided to the control circuit and the reset function is disabled. In detail, because the latching plate 540 is not pulled to allow the reset shaft 180 to penetrate the latching hole 545, the reset shaft 180 does not latch with the latching plate 540. Thus, when the reset button 130 is released, due to the elastic force from the pressed reset spring 240, the reset shaft 180 moves up alone without bringing up the movable assembly 430. When the latching plate 540 is not pressured by the reset shaft 180, the pressed reverse spring 470 bounces back to move up the movable assembly 430. After the elastic forces from the reverse spring 470, the middle spring 220, and the movable contact strips 330, 340 reach a balance, the movable assembly 430 comes back to the first position where movable ends of the movable contact strips 330, 340 separate from the fixed contact strips 200, 210 and the load contact strips 350, 360. The GFCI receptacle 100 remains in the trip condition. Failure to reset the GFCI receptacle 100 provides a warning of the reverse wiring. When an installer cannot reset the GFCI receptacle 100, he realizes that it is wrongly wired and is able to correct the wiring instantly.

In addition, to provide a better protection, if there is a reverse wiring which means line wires are connected to the load ends, the GFCI receptacle 100 cannot function as a receptacle at all and no electricity is provided to any plug-in electronic apparatus. It prevents people from using the receptacle without the protection of ground fault current interruption. Besides, an installer or a user can easily find out the reverse wiring and correct it. Otherwise, people cannot use the GFCI receptacle 100 at all. As described above, because the control circuit is not provided with electricity to perform a reset operation, the GFCI receptacle 100 remains in a trip condition even after the reset button 130 is pressed. There is no conductive path between the load end connections 172, 176 and the binding terminals of user accessible load connections 122, 124 because the load contact strips 350, 360 are separated from the movable contact strips 330, 340.

The receptacle 100 may further contain a reverse-wiring detection circuit to indicate a reverse-wiring condition and to warn an installer by lights or sounds. The reverse-wiring circuit may include a diode, a resistor, and a signal-generating device. The signal-generating device can be a light emitting diode (LED) or an alarm. The LED can be disposed on any location of the face portion 120 as long as lights from the LED can be seen from the top of the receptacle 100. Skilled artisans know there are several ways to apply the LED for signaling a reverse-wiring. For example, when there is a reverse wiring, the red LED turns on to warm an installer and a user. When there is a correct wiring, the green LED turns on to assure that the GFCI receptacle 100 works in a good condition. More than two LEDs may be used. For example, a red LED turns on when there is a reverse wiring and a green (or blue or yellow) LED turns on when there is a correct wiring. As shown in FIG. 16B, an embodiment has a reverse-wiring detection circuit that includes a resistor R8 and an LED component VD1. The LED component contains an LED and a diode. When the GFCI is installed with a reverse wiring, the LED turns on to warn an installer.

A test mechanism is installed to test whether the electrical continuity can be broken by simulating a ground fault condition. The test component comprises the test button 140 and the test strip 230. One end of the test strip 230 is electrically coupled to the left fixed contact strip 210 and the other end hangs under the test button 140. When the electrical continuity is established and the test button 140 is pressed, the test button 140 pushes the test strip 230 down to contact the test resistor 320 of the control circuit. As a result, the control circuit activates the electromagnetic unit to pull the trip shaft 500. Overcoming the elastic force from the trip spring 510, the trip shaft 500 pulls the latching plate 540 to release the reset shaft 180 from the latching hole 545. The pressed reset spring 240 further moves the reset shaft 180 and the reset button 130 up. After releasing from the reset shaft 180, the movable assembly 430 and the latching plate 540 move down due to the elastic forces from the pressed middle spring 220 and the movable contact strips 330, 340. The movable ends of the movable contact strips 330, 340 move down and separate from both the fixed contact strips 200, 210 and the load contact strips 350, 360. When the downward elastic force balances the upward elastic force from the pressed reverse spring 470, the movable assembly 430 is stabilized at the first position where the movable ends of the movable contact strips 330, 340 separate from the fixed contact strips 200, 210 and the load contact strips 350, 360. The protruding contact 550 separates from the reset contact 312 so that the left movable contact strip 330 is not electrically coupled to the reset resistor 310. As a result, the electrical continuity is broken and the GFCI receptacle 100 is in a trip condition.

When the control circuit detects a ground fault condition, it activates the electromagnetic unit to pull the trip shaft 500. The remaining process is the same as that of the test operation.

Figure 16A:
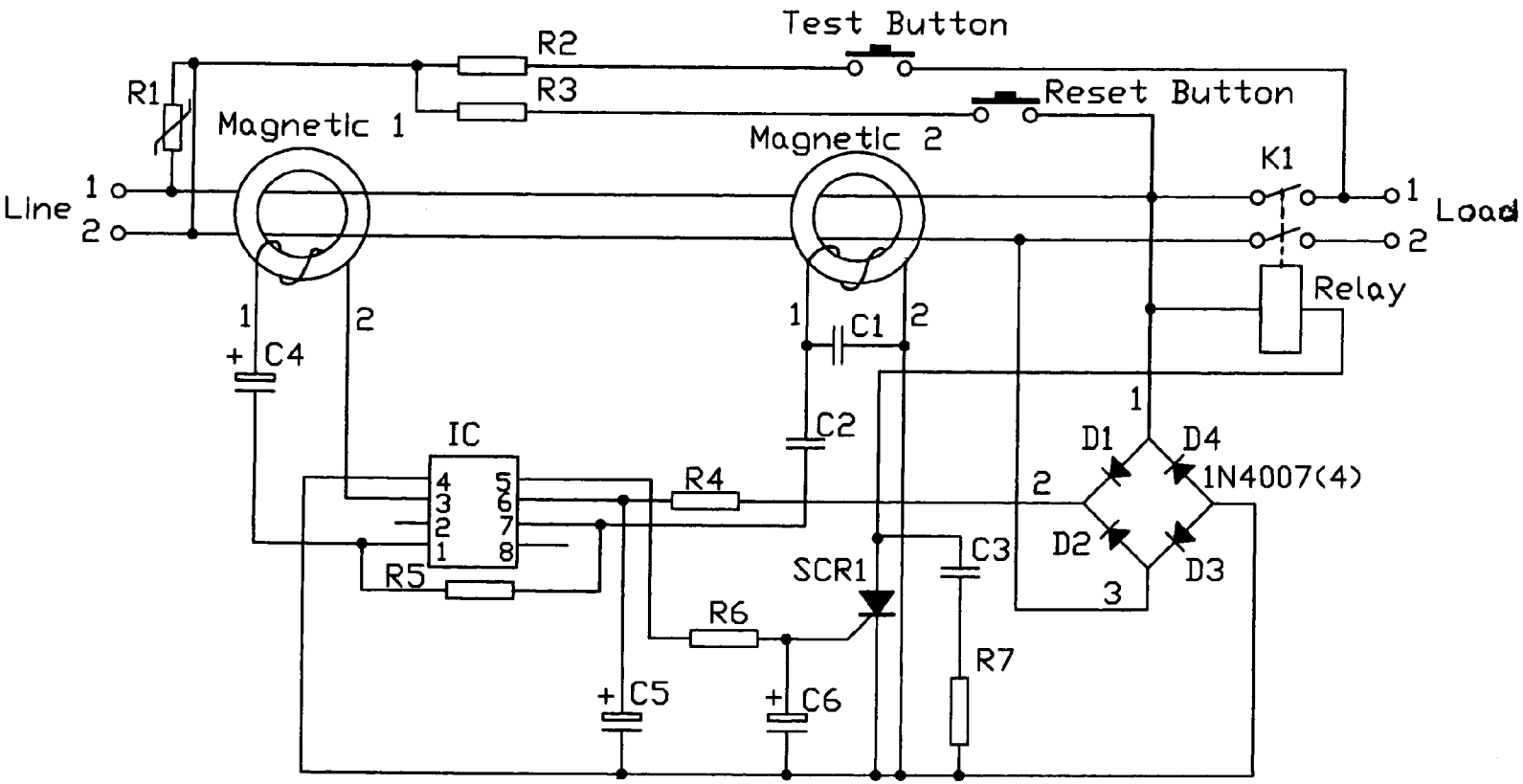
FIG. 16A is a schematic diagram of a control circuit in the current interrupter in FIG. 1.
Figure 16B:
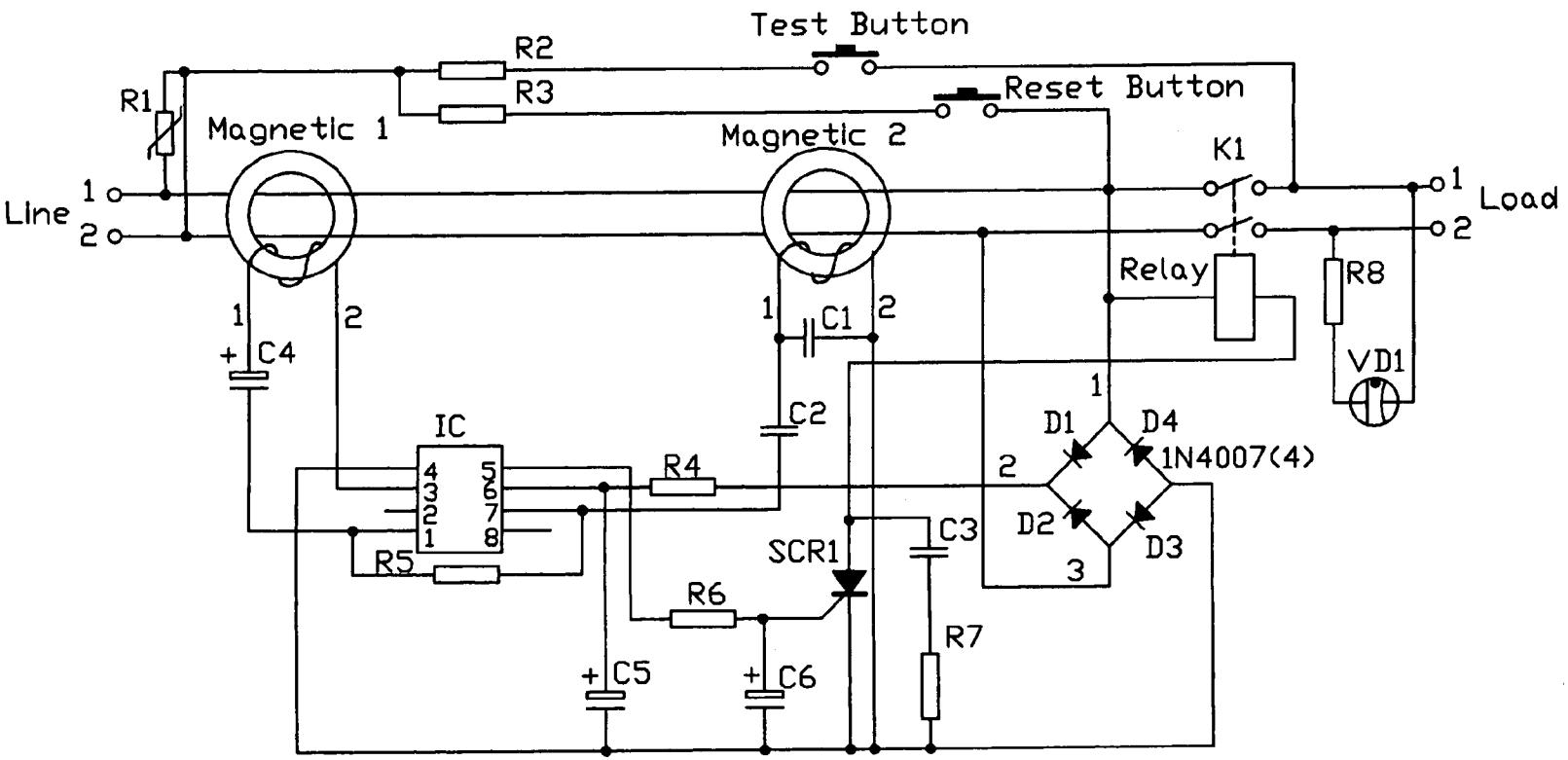
FIG. 16B is a schematic diagram of a control circuit in a current interrupter containing a reverse-wiring detection circuit.

FIG. 16 shows an exemplary embodiment of the control circuit and its relationship with other components of the GFCI receptacle 100. Line 1 is the line phase connection and line 2 is the line neutral connection. Similarly, load 1 is the load phase connection and load 2 is the load neutral connection. The phase and neutral conductive paths of the line side pass through both a sensing transformer U1 (460) and a neutral transformer U2 (450) that are used to detect the imbalance of the currents between the phase and the neutral conductive path.

A resistor R5 connects between the terminal 1 and terminal 7 of an RV 4145 IC. The magnitude of the resistor R5 determines the threshold value for the tripping action of the GFCI receptacle 100 to occur. In other words, if the control circuit detects a current imbalance greater than the threshold value, it activates the electromagnetic unit to break the electrical continuity. In this embodiment, the threshold value is about 4–6 mA.

In the absence of a ground fault condition, the currents following through the phase and neutral conductive paths are equal and opposite. No net flux is generated in the core of the sensing transformer U1 (460). In the event that the current is diverted because of another electrical connection between the phase conductor of the load side and the ground, the currents flowing through the phase and neutral conductors are unequal and a net flux is generated. When the flux reaches the threshold value determined by the resistor R5, the terminal 5 of the IC generates a signal to activate the trip coil 520 of the electromagnetic unit ("Relay" shown in FIG. 16). As a result, the trip shaft 500 pulls the latching plate 540 so that the reset shaft 180 releases from the latching plate 540, and the electrical continuity between the first movable contacts 390, 400 and the load contacts 280, 270 and between the second movable contacts 392, 402 and the fixed contacts 290, 260 is interrupted.

When the GFCI receptacle 100 is in a trip condition and the reset button 130 is pressed, a diverted current flows from line 1 through the reset resistor 310 ("R3" shown in the FIG. 16), the protruding contact 550, the connecting strip 300, and the left movable contact strip 330 to the line 2. An imbalance of the currents flowing through the phase and neutral conductive paths is generated so that terminal 5 of the IC sends a signal to activate the trip coil 520 of the electromagnetic unit. As mentioned above, because the trip shaft 500 pulls the latching plate 540 to latch the reset shaft 180 with the latching hole 545, the movable assembly 430 moves up to the third position where the first movable contacts 390, 400 maintain a good contact with the respective load contacts 280, 270 and the second movable contacts 392, 402 maintain a good contact with the respective fixed contacts 290, 260. The electrical continuity is established.

When the GFCI receptacle 100 is in a reset condition and the test button 140 is pressed, a diverted current flows from line 1 through the test resistor 320 (R2), the test strip 230, and the left fixed contact strip 210 to the line 2. An imbalance of the currents flowing through the phase and neutral conductive paths is generated so that terminal 5 of the IC sends a signal to activate the trip coil 520 of the electromagnetic unit. As mentioned above, because the trip shaft 500 pulls the latching plate 540 to release the reset shaft 180 from the latching hole 545, the movable assembly 430 moves down to the first position where the first movable contacts 390, 400 separate from the respective load contacts 280, 270 and the second movable contacts 392, 402 separate from the fixed contacts 290, 260. The electrical continuity is broken.

Although the invention has been described in terms of exemplary embodiments, it is not limited thereto. The described embodiment is to be considered in all respects only as illustrative and not as restrictive. The present invention may be embodied in other specific forms without departing from its essential characteristics. The scope of the invention, therefore, is indicated by the appended claims rather than by the foregoing description. All changes which come within the meaning and range of the equivalents of the claims are to be embraced within their scope.

What is claimed is:

1. A circuit interrupter comprising:

a pair of fixed contact strips, each of the fixed contact strips having a fixed contact;

a pair of load contact strips, each of the load contact strips having a load contact;

a pair of movable contact strips, each of the movable contact strips having a fixed end and a movable end, the movable end of each movable contact strip split into two sub-strips, each of the movable ends having a first movable contact disposed on one sub-strip arranged for contacting one of the corresponding load contacts and a second movable contact disposed on the other sub-strip arranged for contacting one of the corresponding fixed contacts;

a reset component;

a tripping component comprising a reset contact;

a movable component disposed to sustain the movable ends of the movable contact strips, the movable component capable of either being latched with or released from the reset component to move between a first position where the first movable contacts are separated from the load contacts, and the second movable contacts are separated from the fixed contacts, and the movable contact strips are not electrically coupled to the reset contact, a second position where the first movable contacts are separated from the load contacts, and the second movable contacts are separated from the fixed contacts, and at least one of the movable contact strips is electrically coupled to the reset contact, and a third position where the first movable contacts make contact with the corresponding load contacts, and the second movable contacts make contact with the corresponding fixed contacts, and the movable contact strips are not electrically coupled to the reset contact;

wherein the tripping component capable of latching the reset component with the movable component for the movable component to move to the third position upon detection of a reset request and capable of releasing the reset component from the movable component for the movable component to move to the first position upon detection of a fault condition.

2. The circuit interrupter of claim 1, wherein the load contacts and the fixed contacts have a flat contact surface; and the first movable contacts and the second movable contacts have a protruding contact surface.

3. The circuit interrupter of claim 2, wherein the contact surfaces comprise silver.

4. The circuit interrupter of claim 1, further comprising:

a resistive strip disposed in a way to cause a transient blocking effect when the movable component moves from the first position to the second position.

5. The circuit interrupter of claim 1, wherein the reset component comprises a reset button, a reset shaft attached to the reset button, and a reset spring surrounding an upper portion of the reset shaft.

6. The circuit interrupter of claim 5, wherein the movable component comprises a movable assembly and a latching plate capable of being latched with the reset shaft and holding the movable assembly to move between different positions.

7. The circuit interrupter of claim 6, wherein the movable assembly comprises sustaining portions extended under the movable ends of the movable contact strips, a cavity to accommodate a lower portion of the reset shaft, at least one latching slot for the latching plate to insert, a reverse shaft attached to a lower plate of the movable assembly, and a reverse spring surrounding the reverse shaft.

8. The circuit interrupter of claim 7, wherein the movable assembly further comprises a middle spring disposed in the cavity and surrounding the lower portion of the reset shaft.

9. The circuit interrupter of claim 7, further comprising:

a pair of supporting springs respectively disposed in a spring cavity on the sustaining portions of the movable assembly; and a pair of covering plates respectively disposed on a top of each supporting spring.

10. The circuit interrupter of claim 7, wherein the tripping component comprises a trip shaft capable of being clasped with the latching plate, a trip spring surrounding the trip shaft, an electromagnetic unit capable of moving the trip shaft, and a control circuit to activate the electromagnetic unit upon detecting a predetermined condition.

11. The circuit interrupter of claim 1, further comprising:

a strap for mounting the circuit interrupter and for providing a grounding connection; and a housing to accommodate the movable contact strips, the fixed contact strips, the load contact strips, the reset component, the movable component, and the tripping component.

12. A circuit interrupter comprising:

a pair of fixed contact strips, each of the fixed contact strips having a fixed contact;

a pair of load contact strips, each of the load contact strips having a load contact;

a pair of movable contact strips, each of the movable contact strips having a fixed end and a movable end, the movable end of each movable contact strip split into two sub-strips, each of the movable ends having a first movable contact disposed on one sub-strip arranged for contacting one of the corresponding load contacts and a second movable contact disposed on the other sub-strip arranged for contacting one of the corresponding fixed contacts;

a reset component comprising a reset button, a reset shaft attached to the reset button, and a first elastic tube surrounding an upper portion of the reset shaft;

a movable component comprising a movable assembly and a latching plate capable of being latched with the reset shaft and holding the movable assembly to move between different positions;

a trip component comprising a trip shaft capable of being clasped with the latching plate, a second elastic tube, an electromagnetic unit capable of moving the trip shaft, and a control circuit to activate the electromagnetic unit upon detecting a predetermined condition.

13. The circuit interrupter of claim 12, wherein the movable assembly comprises sustaining portions extended under the movable ends of the movable contact strips, a cavity to accommodate a lower portion of the reset shaft, at least one latching slot for the latching plate to insert, a reverse shaft attached to a lower plate of the movable assembly, and the third elastic tube surrounding the reverse shaft.

14. The circuit interrupter of claim 13, wherein

The movable assembly further comprises a forth elastic tube disposed in the cavity and surrounding the lower portion of the reset shaft.

15. The circuit interrupter of claim 13, wherein the latching plate comprises a latching portion and a clasp portion, the latching portion extending through the latching slot into the movable assembly and having a latching hole for the reset shaft to penetrate, the clasp portion outside the movable assembly having an opening for clasping.

16. The circuit interrupter of claim 15, wherein the clasping portion of the latching plate has a U-shape opening that is capable of moving up and down between different positions while the trip shaft remains clasped with the opening of the latching plate.

17. The circuit interrupter of claim 15, wherein the electromagnetic unit comprises a trip coil, a shield plate, and a metal shield;

the trip shaft is partially disposed inside the trip coil; and the electromagnetic unit, when activated, moving the trip shaft and compress the second elastic tube so that the reset shaft can penetrate into or remove from the latching hole.

18. The circuit interrupter of claim 17, wherein the trip shaft has a wider portion before the shield plate to control a moving distance of the trip shaft.

19. The circuit interrupter of claim 12, further comprising:

a movable assembly accommodation base, a blocking portion of the movable assembly accommodation base extending before or after the latching plate to control a moving distance of the trip shaft.

20. The circuit interrupter of claim 14, wherein the first elastic tube is a reset spring, the second elastic tube is a trip spring, the third elastic tube is a reverse spring, and the fourth elastic tube is a middle spring.

21. The circuit interrupter of claim 20, wherein the reset spring has a larger elastic force than that of the middle spring.

22. The circuit interrupter of claim 20, further comprising:

a middle body disposed between the reset component and the movable component, the middle structure containing an opening through which the reset shaft penetrates;

a circuit board disposed under the reverse shaft, the circuit board containing an opening through which the reverse shaft can penetrate.

23. The circuit interrupter of claim 22, wherein the reset spring is restricted between the reset button and a upper surface of the middle body, the middle spring is restricted between the lower surface of the middle body and a inner wall of the cavity of the movable assembly, the reverse spring is restricted between a lower surface of the lower plate of the movable assembly and an upper surface of the circuit board; the trip spring is restricted between a constricting surface of the trip shaft and the metal shield.

24. The circuit interrupter of claim 12, further comprising:

a test component comprising a test button and a test strip, the test strip having one end hung under the test button and the other end electrically connected to the fixed contact strip.

25. The circuit interrupter of claim 12, further comprising:

a reverse-wiring detection circuit comprising a signal-generating device to detect and signal a reverse wiring.

26. The circuit interrupter of claim 25, wherein the signal-generating device comprises at least one light emitting diode.

27. A circuit interrupter comprising:

a pair of fixed contact strips, each of the fixed contact strips having a fixed contact;

a pair of load contact strips, each of the load contact strips having a load contact;

a pair of movable contact strips, each of the movable contact strips having a fixed end and a movable end, the movable end of each movable contact strip split into two sub-strips, each of the movable ends having a first movable contact disposed on one sub-strip arranged for contacting one of the corresponding load contacts and a second movable contact disposed on the other sub-strip arranged for contacting one of the corresponding fixed contacts;

a reset component;

a movable means for being latched with or released from the reset component to move the movable ends of the movable contact strips between at least two different position;

a tripping means, when activated, for moving a portion of the movable means to latch the reset component with the movable means or to release the reset component from the movable means.

28. The current interrupter of claim 27, wherein at one position, the movable contact strip is capable of forming a close circuit to activate the tripping means and reset the current interrupter.

29. The circuit interrupter of claim 12, wherein the control circuit comprises a reset contact.

30. The circuit interrupter of claim 29, wherein the reset contact is electrically coupled to a reset resistor.

31. The circuit interrupter of claim 12, wherein when the reset button is pressed, one of the removable contact strips is capable of activating the electromagnetic unit for reset operation.

32. The circuit interrupter of claim 29, wherein when the reset button is pressed, one of the movable contact strips is electrically coupled with the reset contact to activate the electromagnetic unit for reset operation.

* * * * *